US005671862A

United States Patent [19]

Cobos

[11] Patent Number: 5,671,862

[45] Date of Patent: Sep. 30, 1997

[54] EXTENDED-LIFE TRASH RECEPTACLE

[76] Inventor: Charles R. Cobos, 4500 Elaine Dr., Bryan, Tex. 77803

[21] Appl. No.: 567,961

[22] Filed: Dec. 6, 1995

[51] Int. Cl.[6] ..... B65D 45/00

[52] U.S. Cl. ..... 220/622; 220/1.5; 220/908

[58] Field of Search ..... 220/638, 616, 220/618, 622, 625, 636, 908, 4.12, 1.5

[56] References Cited

U.S. PATENT DOCUMENTS

| | | | |
|---|---|---|---|
| 89,771 | 5/1869 | Jarboe | 220/622 |
| 234,186 | 11/1880 | Hendrick | 220/618 X |
| 291,904 | 1/1884 | Hill | 220/622 |
| 902,846 | 11/1908 | Smith | 220/618 X |
| 1,066,018 | 7/1913 | Kehoe | 220/616 |
| 1,116,496 | 11/1914 | Schott | 220/622 X |
| 1,733,243 | 10/1929 | Sexton | 220/622 X |
| 2,789,723 | 4/1957 | Perez | 220/625 X |
| 4,955,501 | 9/1990 | Hodge | 220/908 X |
| 5,205,428 | 4/1993 | Yurgevich et al. | 220/636 X |
| 5,289,933 | 3/1994 | Streich et al. | 220/1.5 |

*Primary Examiner*—Steven M. Pollard

*Attorney, Agent, or Firm*—William E. Shull

[57] ABSTRACT

An extended-life trash receptacle includes walls forming a body having an open bottom. A replaceable bottom is adapted to fit within the body. The walls include flanges or other support means on their lower peripheries for supporting the replaceable bottom, and retaining strips or other retaining means for holding the replaceable bottom on the support means. The replaceable bottom is preferably made of plastic, Fiberglas, hard robber, aluminum, or other suitable strong, durable, tough, non-rusting, non-corroding, and relatively chemical-impervious material. If the replaceable bottom becomes worn, punctured, or otherwise damaged in use, it can be quickly and easily replaced by removing the retaining means and lifting the bottom out of the body. A new replaceable bottom can then be dropped into place in the body, and the retaining means reinstalled. The trash receptacle can then be returned to service, thus extending its useful life.

15 Claims, 3 Drawing Sheets

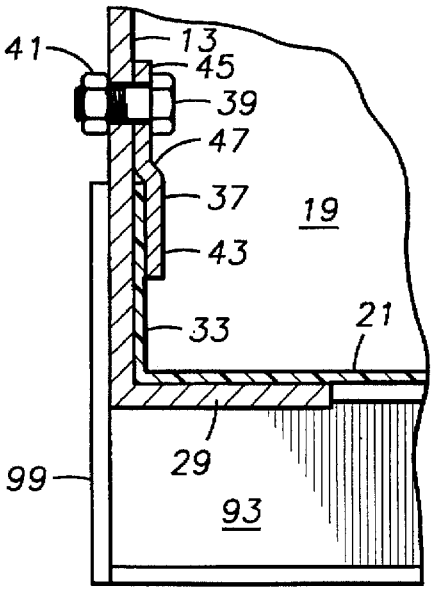
FIG. 3
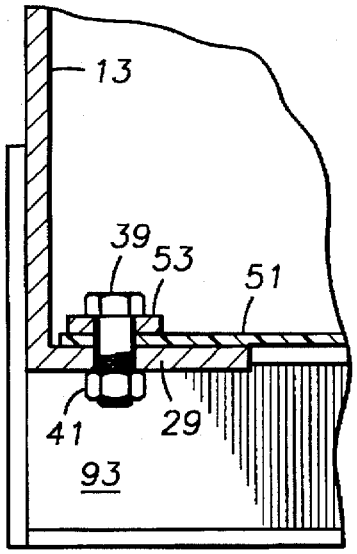
FIG. 4
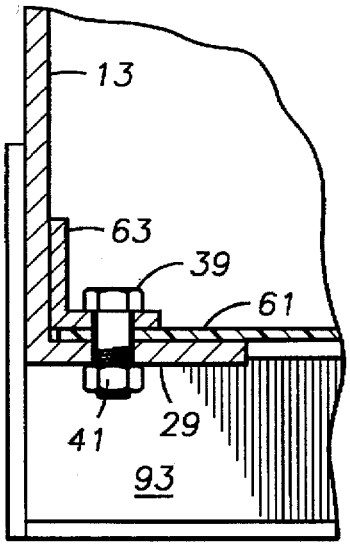
FIG. 5
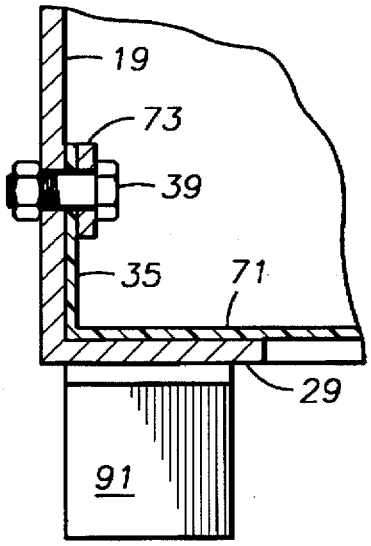
FIG. 6
FIG. 7
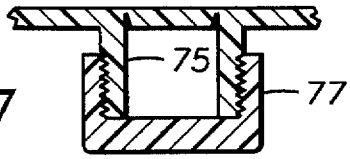
FIG. 8
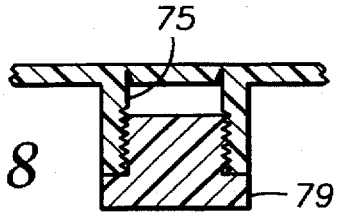

EXTENDED-LIFE TRASH RECEPTACLE

BACKGROUND OF THE INVENTION

The present invention relates generally to the field of trash receptacles, and more particularly to a larger, outdoor-type trash receptacle such as a dumpster or the like, and still more particularly to such a trash receptacle having a replaceable bottom.

Large volume outdoor trash receptacles, such as the familiar "dumpster" and the like, are typically made of common sheet or plate steel or other relatively inexpensive metal and are prone to rust or corrode, particularly on or adjacent to their bottoms, when exposed to moisture, caustic or corrosive chemicals, or other harmful substances from the ground or other support surface, from the weather or other atmospheric conditions, or from the trash or other debris deposited therein by users. Rust or corrosion can occur even when the metal is painted or otherwise coated, because the harsh service and hazardous substances to which trash receptacles are subjected can easily result in the removal of or other damage to the paint or other coating. As is well known, when the paint or coating is removed from an ordinary steel surface at one location and rust or corrosion develops there, it generally results in the spread of the rust or corrosion to adjacent locations. As stated above, the rust and corrosion problems associated with prior art trash receptacles usually surface on or near the bottoms of the receptacles, because the receptacles often stand in water, mud, harsh chemicals or the like, and when these materials are introduced into a receptacle, they of course settle on the bottom.

When the outdoor metal trash receptacles of the prior art become sufficiently rusted or corroded on or adjacent their bottoms, typically they must either be discarded or repaired, because continued use of such rusted-out receptacles is potentially hazardous to both the environment and the users, and could even be unlawful. Discarding the receptacle is less than satisfactory, because of the cost of acquiring another to take its place, and the possibility of additional costs associated with disposal of the worn out unit. Repairs are usually not the answer either, because they are inordinately difficult and time-consuming. Such repairs typically would require that the old bottom be cut off, and a new one welded onto the body. Repairs of this magnitude to outdoor trash receptacles are generally not cost-effective, and consequently are usually not pursued.

Thus, it would be desirable and advantageous to be provided with an outdoor trash receptacle which substantially avoids the drawbacks associated with rust and corrosion at or along the bottom of the receptacle. It would also be advantageous to be provided with such an outdoor trash receptacle which can be easily, quickly, and inexpensively repaired in the event that its bottom becomes damaged by means other than rust or corrosion.

SUMMARY OF THE INVENTION

The extended-life trash receptacle of the present invention includes walls forming a body having an open bottom. The body may be of any suitable configuration, such as rectangular box-shaped, cube-shaped, trapezoidal, circular cylindrical, or the like. A replaceable bottom is adapted to fit within the body. The walls include flanges or other support means on their lower peripheries for supporting the replaceable bottom, and retaining strips or other retaining means for holding the replaceable bottom on the support means. The replaceable bottom is preferably made of plastic, Fiberglas, hard robber, aluminum, or other suitable strong, durable, tough, non-rusting, non-corroding, and relatively chemical-impervious material. Pads disposed on the body elevate the receptacle of the present invention above the ground or other support surface to help avoid moisture or other rust-inducing or otherwise corrosive environmental conditions. Support beams are disposed on the bottom of the body to provide structural support for the body, to help elevate the body, and to provide added support for the replaceable bottom. Further structural support for the body and the replaceable bottom may be provided by braces.

The trash receptacles of the present invention substantially avoid rusting or corroding of their bottoms, which plague the prior art all-metal trash receptacles. If the replaceable bottom becomes worn, punctured, or otherwise damaged in use, it can be quickly and easily replaced by removing the retaining means and lifting the bottom out of the body. A new replaceable bottom can then be dropped into place in the body, and the retaining means reinstalled. The trash receptacle can then be returned to service, thus extending its useful life.

These and other objects and advantages of the invention will become apparent from the following description of the preferred embodiment when read in conjunction with reference to the following drawings, wherein:

BRIEF DESCRIPTION OF THE DRAWINGS

FIG. 3 is a fragmentary view, partly in vertical section and partly in elevation, of a support flange and retaining strip for the replaceable bottom of FIGS. 1 and 2, and a support beam and end cap, in the trash receptacle of FIG. 2, taken along the lines 3—3 of FIG. 2;

FIG. 4 is a view similar to FIG. 3, showing an alternative embodiment of a replaceable bottom and retaining strip for the extended-life trash receptacle of the present invention;

FIG. 5 is a view similar to FIGS. 3 and 4, showing another alternative embodiment of a replaceable bottom and retaining strip for the extended-life trash receptacle of the present invention;

FIG. 6 is a view similar to FIGS. 3, 4 and 5, but showing a corner elevating pad instead of a support beam and end cap, and showing another alternative embodiment of a replaceable bottom and retaining strip for the extended-life trash receptacle of the present invention;

FIG. 7 is a fragmentary vertical sectional view of a drain for the replaceable bottom of the extended-life trash receptacle of the present invention, including a closure cap;

FIG. 8 is a fragmentary vertical sectional view of an alternative embodiment of a drain for the replaceable bottom of the extended-life trash receptacle of the present invention, including a closure plug;

DETAILED DESCRIPTION OF THE PREFERRED EMBODIMENTS OF THE INVENTION

Figure 1:
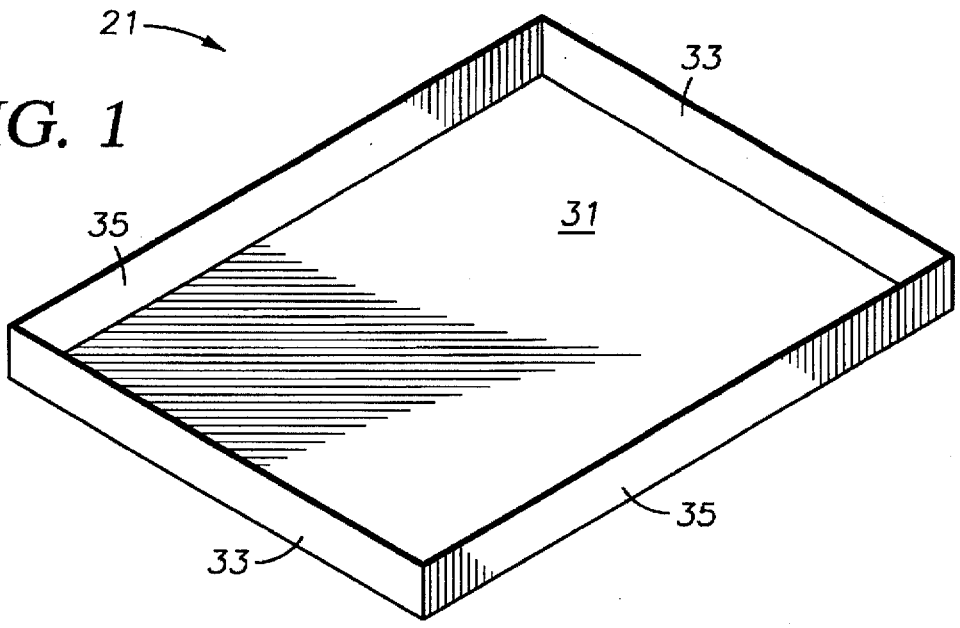
FIG. 1 is an isometric view of one preferred embodiment of a replaceable bottom for the extended-life trash receptacle of the present invention.
Figure 2:
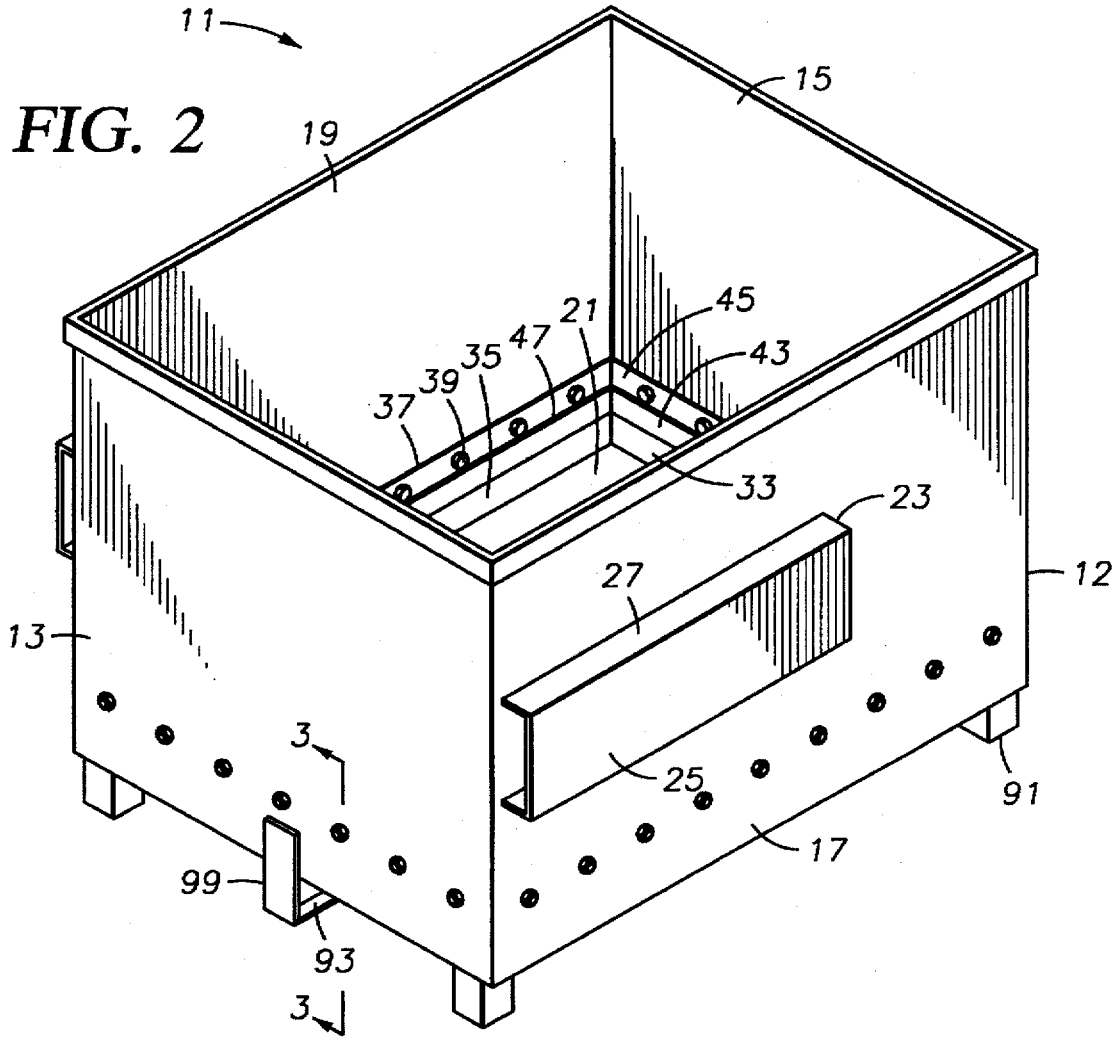
FIG. 2 is an isometric view of one preferred embodiment of the extended-life trash receptacle of the present invention, including the replaceable bottom of FIG. 1.

Referring to the attached drawings, and initially to FIGS. 1–3, the extended-life trash receptacle of the present invention is indicated generally at 11 and includes a body 12 having a front wall 13 and a back wall 15, and a pair of side walls 17, 19 extending therebetween. Walls 13, 15, 17, and 19 are typically made of sheet or plate steel or other metal which tends to rust or corrode when exposed to the elements or other source of corrosive substances or moisture. A replaceable bottom 21 made of plastic (e.g., polyethylene (such as 0.187" thermo-molded high density polyethylene (HDPE)), Fiberglas, hard rubber, aluminum, or other suitable strong, durable, tough, preferably non-rusting and non-corroding, and preferably relatively chemical-impervious material, is releasably attached to front wall 13, back wall 15, and side walls 17, 19 at their lower peripheries. Although less preferred, replaceable bottom 21 may also be made of another metal, e.g.,, sheet or plate steel, or a steel alloy such as Corten-A. Although the trash receptacle 11 shown in FIG. 2 has the general shape of a rectangular box, any other suitable uniform or irregular configuration could be used. For example, receptacle 11 may be generally cube-shaped, or it may be generally trapezoidal, or it may have the general shape of any other suitable polygon. Receptacle 11 may also be circular cylindrical, or the like. Moreover, although the receptacle 11 is shown in the drawings as being open at the top, it may be provided with a lid or door (not shown) to cover all or a part of any such opening in the receptacle body 12. It should be understood that any such opening could alternatively (or in addition) be provided in any of the side, front, or back walls, or other walls (in the event that the body 12 has a shape having walls other than those shown), of the receptacle 11. All or a part of the lid or door may be hinged (not shown) to the body 12 to permit access into or out of the interior of the receptacle, e.g., to permit trash, rubbish, garbage, or other refuse or debris to be deposited in or emptied from the receptacle when opened. When closed, the lid or door will usually be able to prevent much (but not all) of the rain, snow, or other unwanted environmental material from entering receptacle 11.

Receptacle 11 also may include (e.g., for a front-load system) a pair of elongate U-shaped channels or sleeves 23 mounted, as by welding, in corresponding locations on the exterior of side walls 17, 19 and extending longitudinally thereof, the bottoms 25 of the channels being spaced from the adjacent surface of the side walls by legs 27. The spaces between the legs 27 and the bottom 25 of each U-channel and the corresponding surface of the side walls 17, 19 are adapted to receive the lifting arms or forks of a refuse track (e.g., a compacting refuse track), a fork lift, or other suitably equipped vehicle or machinery for lifting and/or tilting receptacle 11, e.g., for emptying the contents of the receptacle into another container or vehicle, or at a dump, a landfill, or the like. Other means of emptying the receptacle 11 may be used, for example, a rear-load system, a side-load system, or the like.

Along the lower periphery of each of walls 13, 15, 17, 19, there is disposed an inwardly extending lip or flange 29 adapted to support replaceable bottom 21 thereon. Flanges 29 are preferably continuous and extend the full lengths of the walls in order to fully distribute the load carried by the replaceable bottom 21. So long as adequate support is provided, however, other support means could be used in place of flanges 29, e.g., tabs, ears, struts, or the like. Body 12 could also have a solid bottom, rather than a relatively open bottom as shown in the drawings. In the preferred embodiment, the adjacent ends of the flanges are connected together, as by welding, at the corners of the body 12 for increased strength.

According to one embodiment oft he invention, replaceable bottom 21 generally comprises a shallow pan having a bottom 31, and relatively low front and back walls 33 and side walls 35. Replaceable bottom 21 is sized and shaped to rest upon flanges 29. Replaceable bottom 21 should be nearly as long and wide as the surface or space defined by the flanges 29 for adequate support, but with enough clearance between it and walls 13, 15, 17, 19 so that it may be easily dropped in place on the flanges from above.

When in place atop flanges 29, bottom 21 is held in place by a plurality of elongate retaining strips 37. A retaining strip 37 is preferably provided for each of the walls 13, 15, 17, 19. Strips 37 may be made of metal, plastic, Fiberglas, hard robber, or other suitable strong, tough, durable, preferably rust- and corrosion-resistant, and relatively chemical-impervious material, and are fastened to the inside surfaces of walls 13, 15, 17, 19, as by bolts 39 and nuts 41. Other mechanical means of fastening strips 37 to walls 13, 15, 17, 19 could also be used, such as screws, riveting, or welding, such as spot welding, but bolts and nuts or screws are preferred because they facilitate quick and easy removal of the retaining strips and removal and replacement of bottom 21. Strips 37 could also be affixed to the walls by an adhesive. If such other means of attachment of strips 37 to body 12 were used, such as riveting or spot welding or adhesives, removal of strips 37 would still be feasible, although more difficult than is the case with bolts and nuts or screws.

As shown in FIG. 3, a lower portion 43 of each of the retaining strips 37 overlaps the upper edge portion of walls 33, 35 of replaceable bottom 21. Strips 37 thus help to funnel material into bottom 21, and also protect the upper edges of walls 33, 35. An upper portion 45 of strips 37 includes an aperture which receives the shafts of bolts 39. An aperture is also disposed in the walls 13, 15, 17, 19 for receiving each of the bolts 39. Alternatively, bolts 39 could be disposed in lower portion 43, through the walls of both bottom 21 and body 12. An upset portion 47 is preferably disposed between upper portion 45 and lower portion 43 of strips 37, and is configured to accommodate the thickness of walls 33, 35 of bottom 21 and permit the upper portion 45 to lie flush against the respective wall 13, 15, 17, 19, and the lower portion 43 to lie flush against the respective wall 33, 35. If desired, strips 37 may alternatively be made flat, i.e., without upset portion 47.

An alternative construction of extended-life trash receptacle 11 is shown in FIG. 4. As shown therein, a replaceable bottom 51 comprises a substantially flat piece of the same type of material of which bottom 21 is made. Bottom 51 is removably secured to flanges 29, preferably by bolts 39 and nuts 41. As indicated above in connection with bottom 21, however, other fastening means could also be used. In the preferred form of this embodiment, the bolts 39 are disposed in apertures in the flanges 29, rather than in the walls 13, 15, 17, and 19. An elongate retaining strip 53 is preferably disposed between the heads of bolts 39 and the upper surface of bottom 51 for strengthening the attachment of bottom 51 to flanges 29. Of course, apertures will be disposed in the retaining strip 53 and the bottom 51 to receive each of the bolts 39 therewithin.

Another alternative construction of extended-life trash receptacle 11 is shown in FIG. 5. As shown therein, a replaceable bottom 61 comprises, like bottom 51, a substantially flat piece of the same type of material of which bottoms 21 and 51 are made. Bottom 61 is removably secured to flanges 29, preferably by bolts 39 and nuts 41 (again, other fastening means are acceptable), in this embodiment such bolts being disposed, as in the case of FIG. 4, in apertures in the flanges 29, rather than in the walls 13, 15, 17, and 19, and in bottom 61. An elongate angle strip 63 serves as a retaining means. Angle strip 63 is preferably disposed such that one of its flanges is located between the heads of bolts 39 and the upper surface of bottom 61, and the other flange of strip 63 is disposed against the respective wall 13, 15, 17, 19 for strengthening the attachment of bottom 61 to flanges 29. The flange of retaining strip 63 disposed against the surface of bottom 61 includes apertures for receiving the bolts 39 therewithin.

Another alternative embodiment of receptacle 11 is shown in FIG. 6. In this embodiment, replaceable bottom 71 is substantially the same as bottom 21. It rests upon flanges 29 and is seemed in place thereon by bolts 39 disposed in apertures in the walls 33, 35 of bottom 71, and in apertures in the walls 13, 15, 17, and 19. A retaining strip 73, like strip 53, is disposed near the tops of walls 33, 35. Retaining strip 73 includes apertures in which are disposed bolts 39; strip 73 is disposed between the heads of bolts 39 and the inside surface of walls 33, 35.

Referring to FIGS. 7 and 8, the replaceable bottom (e.g., as shown at 21, 51, 61, 71) preferably includes a drain 75 which may, for example, be molded therein. Drain 75 may be closed with, for example, a metal or plastic cap 77 as shown in FIG. 7, or a metal or plastic plug 79 as shown in FIG. 8. Cap 77 or plug 79 may be screwed onto or into the drain 75, or they could be snap-fitted or frictionally retained in place. If desired, drain 75 as molded into the replaceable bottom may have a closed end so that it can be kept closed if no drain is needed, or punched out and thus opened for use. Providing drain 75 as described gives the present invention an advantage over prior art all-metal receptacles in that a drain would have to be welded in place in the side or bottom of the receptacle, which of course is a more time-consuming and complicated process than simply molding the drain into the replaceable bottom according to the present invention.

At each corner of receptacle body 12, it is preferred that a relatively short metal pad 91 be mounted on the body, as by welding, in order to keep the bulk of receptacle 11 elevated from the ground or other support surface, and thus away from any potential source of moisture or other corrosive substance disposed thereon. Pads 91 are preferably mounted on the undersides of the flanges 29. If additional support for the body 12 is necessary or desired, additional pads 91 can be mounted on the body between those disposed at the corners.

Figure 9:
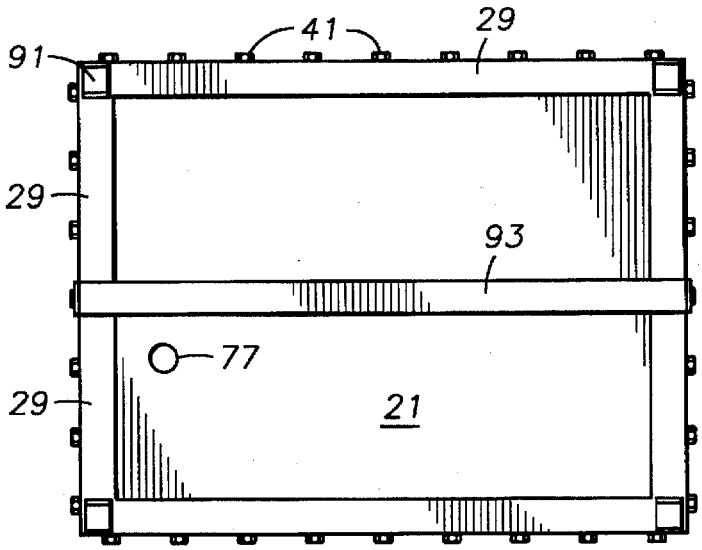
FIG. 9 is a bottom plan view of one embodiment of the support structure for the body and replaceable bottom of the extended-life trash receptacle of the present invention.
Figure 10:
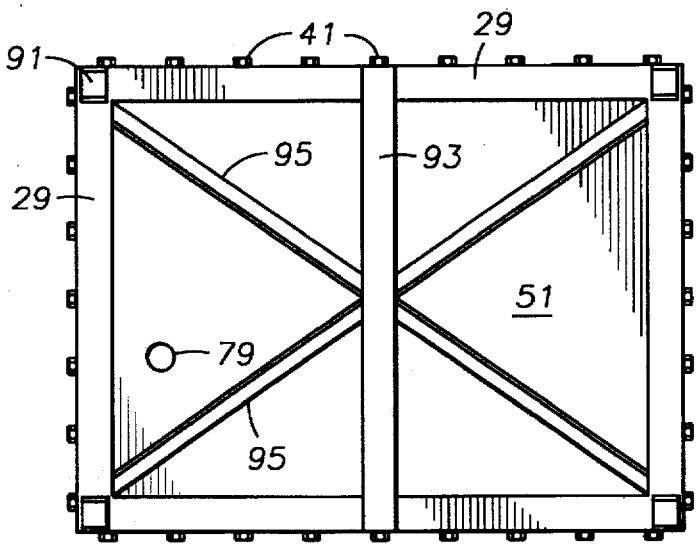
FIG. 10 is a bottom plan view of an alternative embodiment of the support structure for the body and replaceable bottom of the extended-life trash receptacle of the present invention.
Figure 11:
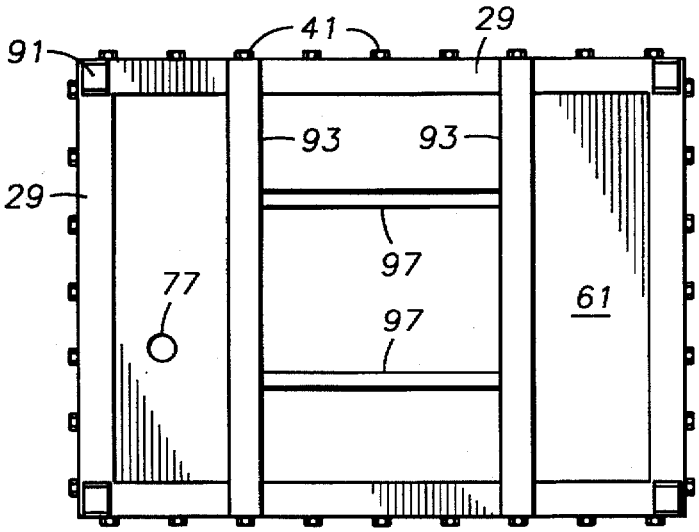
FIG. 11 is a bottom plan view of another alternative embodiment of the support structure for the body and replaceable bottom of the extended-life trash receptacle of the present invention.

As shown in FIG. 9, further support for the body 12 of receptacle 11 and for the replaceable bottom may be provided by a beam 93 mounted, as by welding (but other fastening means may be used as referred to above), at its opposite ends on the flanges 29 and extending longitudinally from front to back of receptacle 11. Alternatively, as shown in FIG. 10, beam 93 could be mounted on body 12 so that it extends transversely, from side to side. Beam 93 may be, for example, an I-beam, a C-channel beam, or the like. If additional support is needed, a second or more of such beams 93 could be used, as shown in FIG. 11. The multiple beams can extend either longitudinally or transversely, as referred to above. If multiple beams 93 were used, then pads 91 may not be necessary.

Still further support for the body 12 (including to prevent twisting or other deformation of the bottom opening under load) and replaceable bottom may be provided, if desired, by using one or more corner-to-corner braces 95 as shown in FIG. 10, or one or more intermediate braces 97 disposed between beams 93, as shown in FIG. 11. Braces 95, 97 may preferably be made of angle metal for strength, but as an alternative they could be flat metal strips, or rods. Braces 95, 97 are preferably welded to flanges 29 or beams 93, as the case may be, but they may also be fastened thereto by other means such as screws, nuts and bolts, rivets, adhesives, or the like.

As shown in FIGS. 2 and 3–6, an end cap 99 may be mounted, as by welding, to the end of beam 93 and to the front wall 13 of body 12. As in the case of other structural support members referred to above, other means of attachment could also be used. This ties beam 93 into wall 13 and provides additional structural support for body 12. It also tends to reinforce body 12 against a source of possible corrosion at the inside corner between wall 13 and flange 29. Another end cap may be provided at the back of body 12, mounted on the other end of beam 93 and to the back wall 15. Such end caps could also be provided if transversely extending beams are used as shown in FIGS. 10 and 11, instead of one or more longitudinally extending beams. In that event, the end caps would be mounted to beam(s) 93 and to side walls 17, 19.

In use, the replaceable bottom of the present invention will typically be made of a rust- and corrosion-resistant material so that it avoids the rust and corrosion which plague prior art receptacles. If the bottom becomes worn, punctured, or otherwise damaged in use, it can be quickly and easily replaced by removing the respective retaining means, e.g., nuts 39, bolts 41, and strips 37, 53, 63, 73, or the like, and lifting the bottom out of the body 12. A new replaceable bottom can then be dropped into place in body 12, e.g. atop flanges 29, and the retaining means replaced. Receptacle 11 can then be returned to service, thus extending its useful life.

While preferred embodiments of the invention have been shown and described, many modifications thereof may be made by those skilled in the art without departing from the spirit of the invention. Accordingly, the scope of the invention should be determined in accordance with the following claims.

I claim:

1. An extended-life trash receptacle, comprising:

a plurality of contiguous metal walls forming a body having an open bottom;

a replaceable bottom member having a lower surface and adapted to fit within and substantially cover said open bottom of said body;

support means disposed on said walls of said body for engaging said lower surface of said replaceable bottom member for supporting said replaceable bottom member within said body;

retaining means releasably mounted about said body for engaging an upper portion of said replaceable bottom member and holding said replaceable bottom member in place on said support means;

said support means including a plurality of inwardly extending flanges disposed on the lower peripheral edges of said walls, on which said replaceable bottom member may rest;

said replaceable bottom member including a bottom portion having said lower surface and walls extending upwardly therefrom, and said retaining means including an elongate strip releasably attached to each of said walls of said body and sandwiching each of said walls of said replaceable bottom member between said strips and said walls of said body;

said elongate strips including an upper portion disposed against said walls of said body and a lower portion disposed against said walls of said replaceable bottom member for sandwiching said walls of said replaceable bottom member against said walls of said body, and including releasable mounting means disposed through said upper portions of said elongate strips and said walls of said body.

2. An extended-life trash receptacle according to claim 1, wherein said elongate strips include an offset portion disposed between said upper and lower portions of said strips for accommodating the thickness of said walls of said replaceable bottom member, and permitting said upper portions of said elongate strips to lie substantially flush against said walls of said body, and said lower portions of said elongate strips to lie flush against said walls of said replaceable bottom member.

3. An extended-life trash receptacle according to claim 1, wherein said replaceable bottom member is composed of a rust-resistant and corrosion-resistant material.

4. An extended-life trash receptacle according to claim 3, wherein said replaceable bottom member is made of a plastics material.

5. An extended-life trash receptacle according to claim 4, wherein said plastics material is polyethylene.

6. An extended-life trash receptacle according to claim 3, wherein said replaceable bottom member is made of aluminum.

7. An extended-life trash receptacle according to claim 3, wherein said replaceable bottom member is made of hard rubber.

8. An extended-life trash receptacle according to claim 3, wherein said replaceable bottom member is made of Fiberglas.

9. An extended-life trash receptacle according to claim 1, further including a support beam attached to the undersides of a pair of said flanges disposed on opposite sides of said body.

10. An extended-life trash receptacle according to claim 9, further including an end cap mounted on one end of said support beam and attached to a wall of said body adjacent said end cap.

11. An extended-life trash receptacle according to claim 9, further including support braces attached to the upper surfaces of said flanges and extending from corner to corner of said body.

12. An extended-life trash receptacle according to claim 9, further including a second support beam attached to the undersides of said pair of said flanges.

13. An extended-life trash receptacle according to claim 12, further including an intermediate brace disposed between the two support beams.

14. An extended-life trash receptacle according to claim 9, further including an elevating pad disposed on the body at each corner.

15. An extended-life trash receptacle according to claim 1, wherein said replaceable bottom member includes a drain formed therein.

* * * * *